US008864279B2

(12) United States Patent
Misumi

(10) Patent No.: US 8,864,279 B2
(45) Date of Patent: Oct. 21, 2014

(54) PRINTING DEVICE

(75) Inventor: Kazuhito Misumi, Konan (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 268 days.

(21) Appl. No.: 13/420,346

(22) Filed: Mar. 14, 2012

(65) Prior Publication Data

US 2013/0027448 A1 Jan. 31, 2013

(30) Foreign Application Priority Data

Jul. 28, 2011 (JP) ..... 2011-164955

(51) Int. Cl.
*B41J 29/393* (2006.01)
*B41J 2/175* (2006.01)

(52) U.S. Cl.
CPC ..... *B41J 2/17546* (2013.01)
USPC ..... 347/19; 347/85; 347/86; 347/87

(58) Field of Classification Search
USPC ..... 347/19, 85–87
See application file for complete search history.

(56) References Cited

U.S. PATENT DOCUMENTS

| | | | | |
|---|---|---|---|---|
| 4,853,708 | A * | 8/1989 | Walters | 347/86 |
| 7,581,807 | B2 * | 9/2009 | Hatasa et al. | 347/19 |
| 2003/0002080 | A1 | 1/2003 | Asauchi | |
| 2003/0011654 | A1 | 1/2003 | Asauchi | |
| 2005/0151811 | A1 | 7/2005 | Shimizu et al. | |
| 2005/0179750 | A1 | 8/2005 | Hayasaki et al. | |
| 2005/0185034 | A1 | 8/2005 | Anma et al. | |
| 2005/0219303 | A1 | 10/2005 | Matsumoto et al. | |
| 2006/0087538 | A1 | 4/2006 | Amma et al. | |
| 2006/0284919 | A1 | 12/2006 | Kuribayashi et al. | |

FOREIGN PATENT DOCUMENTS

| | | | |
|---|---|---|---|
| JP | 2002-370378 | A | 12/2002 |
| JP | 2005-205886 | A | 8/2005 |
| JP | 2006-142484 | A | 6/2006 |
| JP | 2006-142832 | A | 6/2006 |
| JP | 2007-001031 | A | 1/2007 |
| JP | 2007-001208 | A | 1/2007 |
| JP | 2007-144770 | A | 6/2007 |
| JP | 2008-290462 | A | 12/2008 |
| JP | 2009-040061 | A | 2/2009 |
| JP | 2009-040062 | A | 2/2009 |
| JP | 2009-132157 | A | 6/2009 |
| JP | 2010-132003 | A | 6/2010 |
| JP | 2010-188574 | A | 9/2010 |

* cited by examiner

*Primary Examiner* — Julian Huffman
(74) *Attorney, Agent, or Firm* — Merchant & Gould PC

(57) ABSTRACT

A communicating section communicates with a memory element of each of first cartridges via first mount sections. The communicating section has first terminals and second terminals. First signal lines connect the first terminals with the first mount sections. Second signal lines connect the second terminals with the first mount sections. The first mount sections form a plurality of groups. The first mount sections in each group are connected in common with one of the first terminals via a corresponding first signal line. The first mount sections in one group are connected with the second terminals that are different from each other via respective second signal lines. Each of the second terminals is connected with one of the first mount sections in one group and with one of the first mount sections in another group via a corresponding second signal line.

20 Claims, 8 Drawing Sheets

FIG. 4

TB1

| INSERTION OPENING | INSERTION OPENING NUMBER (120) | CORRESPONDING CARTRIDGE INFORMATION (121) | CARTRIDGE MOUNT INFORMATION (114) |
|---|---|---|---|
| INSERTION OPENING 60C | 1 | CARTRIDGE 64C | – |
| INSERTION OPENING 60M | 2 | CARTRIDGE 64M | NORMAL |
| INSERTION OPENING 60Y | 3 | CARTRIDGE 64Y | NORMAL |
| INSERTION OPENING 60K | 4 | CARTRIDGE 64K | – |

PRINTING DEVICE

CROSS REFERENCE TO RELATED APPLICATIONS

This application claims priority from Japanese Patent Application No. 2011-164955 filed Jul. 28, 2011. The entire content of the priority application is incorporated herein by reference.

TECHNICAL FIELD

The invention relates to a printing device.

BACKGROUND

A printing device is proposed that reads out predetermined information from a detachable replacement part (for example, an ink cartridge). For example, an ink cartridge is provided with a memory element (for example, an IC chip). The memory element stores cartridge information relating to color of ink, whether or not the cartridge is a genuine product of a manufacturer, and the like. Further, a mount section on which the cartridge is mounted is provided with a part (for example, an electrode) used for communication with the memory element of the cartridge. An integrated circuit of the printing device reads out the cartridge information from the ink cartridge mounted on the mount section, determines whether printing can be performed, and provides various notifications to a user.

SUMMARY

It is an object of the invention to provide technology that suppresses the size of the integrated circuit and manufacturing costs.

In order to attain the above and other objects, the invention provides a printing device. The printing device includes a printer section, a plurality of first mount sections, a communicating section, a plurality of first signal lines, and a plurality of second signal lines. The printer section is configured to perform printing on a recording medium with developer. A plurality of kinds of first cartridges is configured to be mounted on the plurality of first mount sections, respectively. Each of the plurality of kinds of first cartridges has a memory element for storing cartridge information. A communicating section is configured to communicate with the memory element via the plurality of first mount sections. The communicating section has a plurality of first terminals and a plurality of second terminals. The plurality of first signal lines connects the plurality of first terminals with the plurality of first mount sections. The plurality of second signal lines connects the plurality of second terminals with the plurality of first mount sections. The plurality of first mount sections forms a plurality of groups. The first mount sections in each group are connected in common with one of the first terminals via a corresponding first signal line. The first mount sections in one group are connected with the second terminals that are different from each other via respective second signal lines. Each of the second terminals is connected with one of the first mount sections in one group and with one of the first mount sections in another group via a corresponding second signal line.

According to another aspect, the invention also provides a printing device. The printing device includes a printer section, a plurality of first mount sections, a communicating section, a plurality of first signal lines, and a plurality of second signal lines. The printer section is configured to perform printing on a recording medium with developer. A plurality of kinds of first cartridges is configured to be mounted on the plurality of first mount sections, respectively. Each of the plurality of kinds of first cartridges has a memory element for storing cartridge information. A communicating section is configured to communicate with the memory element via the plurality of first mount sections. The communicating section has a plurality of first terminals and a plurality of second terminals. The plurality of first signal lines connects the plurality of first terminals with the plurality of first mount sections. The plurality of second signal lines connects the plurality of second terminals with the plurality of first mount sections. Each of the plurality of first terminals is connected with two or more first mount sections via the first signal lines. Each of the plurality of second terminals is connected with two or more first mount sections via the second signal lines.

BRIEF DESCRIPTION OF THE DRAWINGS

Embodiments in accordance with the invention will be described in detail with reference to the following figures wherein:

FIG. 4 is an explanatory diagram showing an example of a table;

DETAILED DESCRIPTION

<Configuration of MFP>

An MFP embodying a printing device according to an embodiment of the invention will be described while referring to FIGS. 1 through 4.

Figure 1:
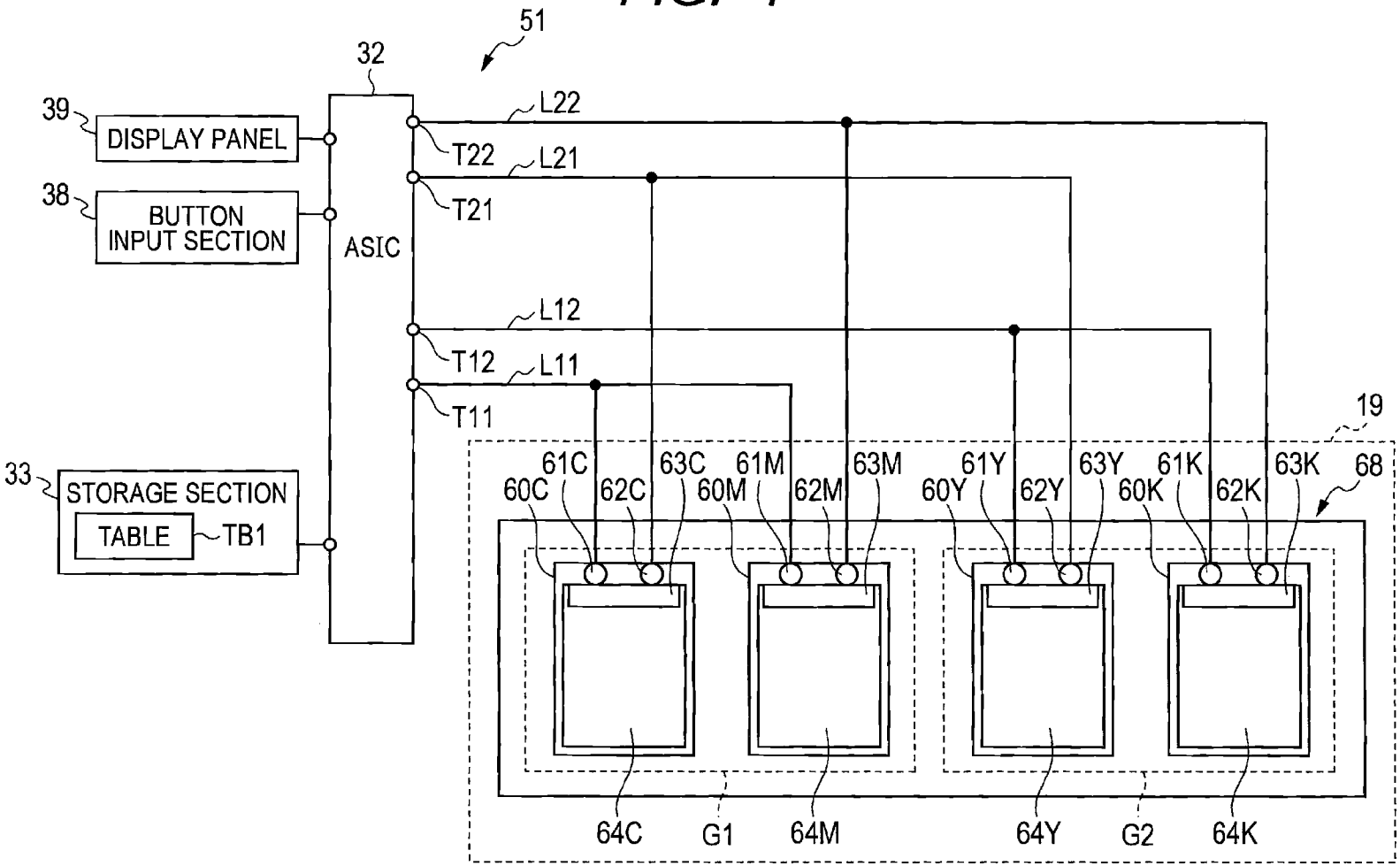
FIG. 1 is a block diagram of a multifunction peripheral (MFP) according to an embodiment of the invention.

FIG. 1 shows a block diagram of a partial configuration of an MFP (Multifunction Peripheral) 51 according to the embodiment. The MFP 51 is a device having a print function of performing printing using ink accommodated in cartridges. The MFP 51 mainly includes an ASIC (Application Specific Integrated Circuit) 32, a storage section 33, a button input section 38, a display panel 39, and a printer section 19. Note that the MFP 51 further includes a scanner section that performs scanning of an original document and the like, which are omitted in FIG. 1 for simplicity. The ASIC 32 is an integrated circuit for executing various processes described later. The button input section 38 is keys for performing each function of the MFP 51. The display panel 39 displays various functioning information of the MFP 51. The button input section 38 and the display panel 39 are connected with the ASIC 32.

The printer section 19 performs printing. The printer section 19 includes a carriage 68. The carriage 68 is for mounting cartridges. The carriage 68 includes insertion openings 60C, 60M, 60Y, and 60K. The insertion openings 60C, 60M, 60Y, and 60K correspond to colors of cyan (C), magenta (M), yellow (Y), and black (K), respectively. Cartridges 64C, 64M, 64Y, and 64K are detachably mounted on the insertion openings 60C, 60M, 60Y, and 60K, respectively. The cartridges 64C, 64M, 64Y, and 64K accommodate ink in colors of cyan (C), magenta (M), yellow (Y), and black (K), respectively. Hence, the correct color combinations are a combination of the insertion opening 60C and the cartridge 64C, a combination of the insertion opening 60M and the cartridge 64M, a combination of the insertion opening 60Y and the cartridge 64Y, and a combination of the insertion opening 60K and the cartridge 64K. The cartridges 64C, 64M, 64Y, and 64K have shapes that can also be mounted on any insertion opening other than the insertion opening of the correct color combination.

The cartridges 64C, 64M, 64Y, and 64K includes IC chips 63C, 63M, 63Y, and 63K, respectively. The IC chips 63C, 63M, 63Y, and 63K are memory elements for storing cartridge information that is various information relating to each cartridge. The cartridge information includes cartridge color information, compatibility information, cartridge identifying information, and the like. The cartridge color information is information for indicating color of ink accommodated in the cartridge. The compatibility information is information for indicating whether the cartridge is compatible with the MFP 51 (that is, the cartridge is a genuine product of a manufacturer of the MFP 51). The cartridge identifying information is information for identifying the cartridge. An example of the cartridge identifying information includes a manufacture serial number.

The configuration of the insertion openings will be described, taking the insertion opening 60C as an example. A first electrode 61C and a second electrode 62C are provided at the insertion opening 60C for connection with the IC chip of the cartridge. The IC chip 63C has a plurality of pads (not shown) for connection with respective ones of the first electrode 61C and the second electrode 62C. When the cartridge 64C is properly mounted on the insertion opening 60C, the plurality of pads of the IC chip 63C makes contact with the first electrode 61C and the second electrode 62C, respectively. In this state, the ASIC 32 and the IC chip 63C can communicate with each other via a first signal line L11 and a second signal line L21. Note that, because each configuration of the insertion openings 60M, 60Y, and 60K is similar to that of the insertion opening 60C, detailed descriptions are omitted.

The ASIC 32 includes first terminals T11 and T12 and second terminals T21 and T22. The first terminal T11 is connected with the first electrodes 61C and 61M via the first signal line L11. The first terminal T12 is connected with the first electrodes 61Y and 61K via the first signal line L12. The second terminal T21 is connected with the second electrodes 62C and 62Y via the second signal line L21. The second terminal T22 is connected with the second electrodes 62M and 62K via the second signal line L22. The ASIC 32 outputs various commands via the first terminals T11 and T12. The first signal line L11 transmits commands outputted from the first terminal T11 to the IC chips 63C and 63M. The first signal line L12 transmits commands outputted from the first terminal T12 to the IC chips 63Y and 63K. The IC chips 63C, 63M, 63Y, and 63K output various output signals as responses to inputted commands. The second signal line L21 transmits output signals outputted from the IC chips 63C and 63Y to the second terminal T21. The second signal line L22 transmits output signals outputted from the IC chips 63M and 63K to the second terminal T22.

The wiring configuration of the first signal line and the second signal line will be described. As shown in FIG. 1, a group G1 is formed by the insertion openings 60C and 60M of which the first signal line L11 is connected with the common first terminal T11. Further, a group G2 is formed by the insertion openings 60Y and 60K of which the first signal line L12 is connected with the common first terminal T12.

The second signal line L21 of the insertion opening 60C in the group G1 and the second signal line L22 of the insertion opening 60M in the group G1 are connected with different second terminals (the second terminals T21 and T22). Here, the second terminal T21 with which the second signal line L21 of the insertion opening 60C in the group G1 is connected is a terminal with which the second signal line L21 of the insertion opening 60Y in the group G2 (which is another group) is connected. Further, the second terminal T22 with which the second signal line L22 of the insertion opening 60M in the group G1 is connected is a terminal with which the second signal line L22 of the insertion opening 60K in the group G2 (which is another group) is connected.

Similarly, the second signal line L21 of the insertion opening 60Y in the group G2 and the second signal line L22 of the insertion opening 60K in the group G2 are connected with different second terminals (the second terminals T21 and T22). Here, the second terminal T21 with which the second signal line L21 of the insertion opening 60Y in the group G2 is connected is a terminal with which the second signal line L21 of the insertion opening 60C in the group G1 (which is another group) is connected. Further, the second terminal T22 with which the second signal line L22 of the insertion opening 60K in the group G2 is connected is a terminal with which the second signal line L22 of the insertion opening 60M in the group G1 (which is another group) is connected.

The storage section 33 includes a RAM (Random Access Memory), a ROM (Read Only Memory), a flash memory, a HDD (Hard Disk Drive), and the like, all of which constitute the storage section in combination. The storage section 33 stores a table TB1. FIG. 4 shows an example of the table TB1. The table TB1 stores an insertion opening number 120, corresponding cartridge information 121, and cartridge mount information 114 for each of the insertion openings 60C, 60M, 60Y, and 60K. The insertion opening number 120 is a consecutive number that is assigned to each of the insertion openings 60C, 60M, 60Y, and 60K. The corresponding cartridge information 121 is information for indicating a cartridge in color matching the color of the insertion opening (that is, the cartridge of the correct color combination) for each of the insertion openings 60C, 60M, 60Y, and 60K. The cartridge mount information 114 is information for indicating whether a cartridge in color matching the color of the insertion opening is mounted.

<Processes of MFP>

Figure 2:
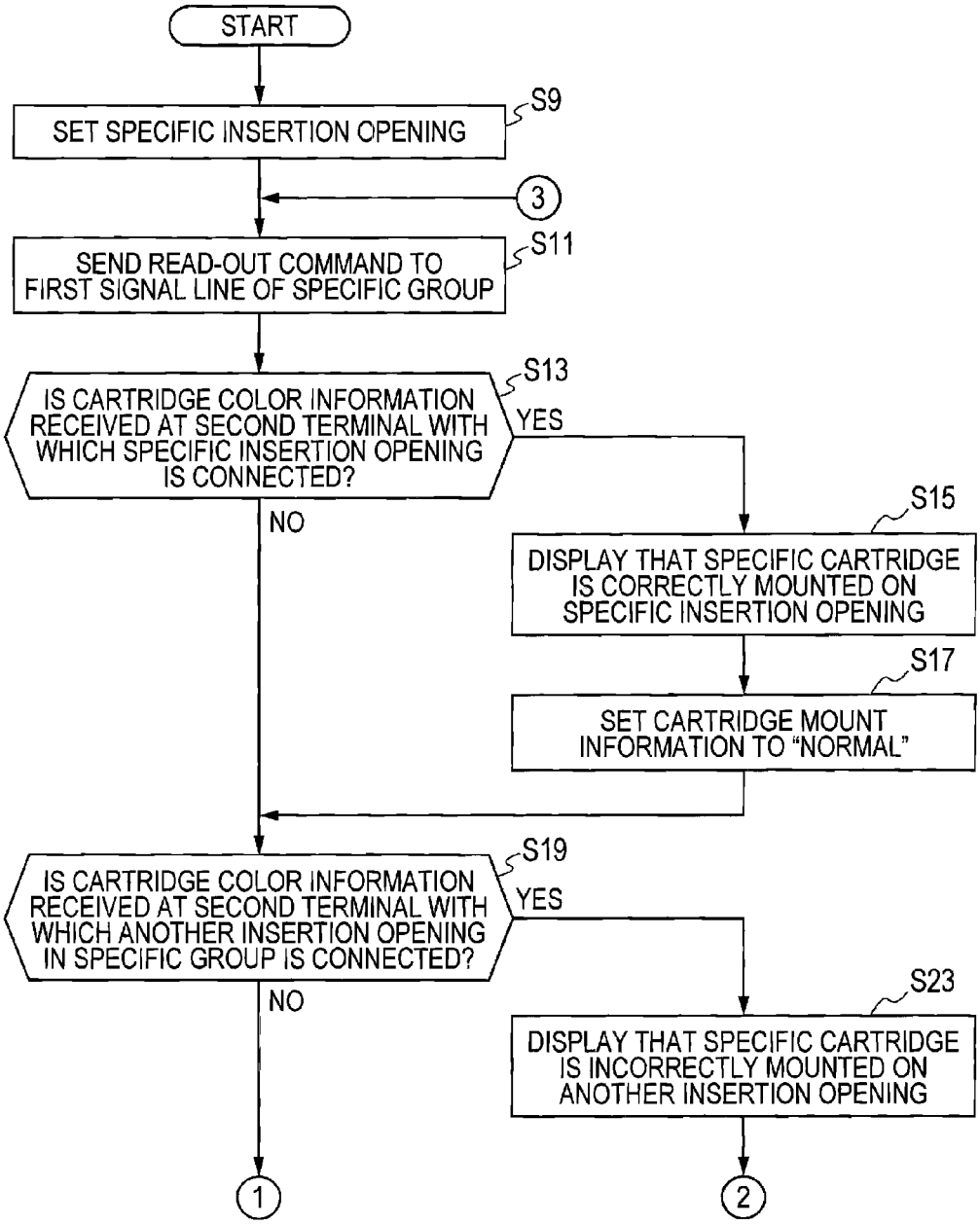
FIG. 2 is a flowchart showing part of processes executed by the MFP.
Figure 3:
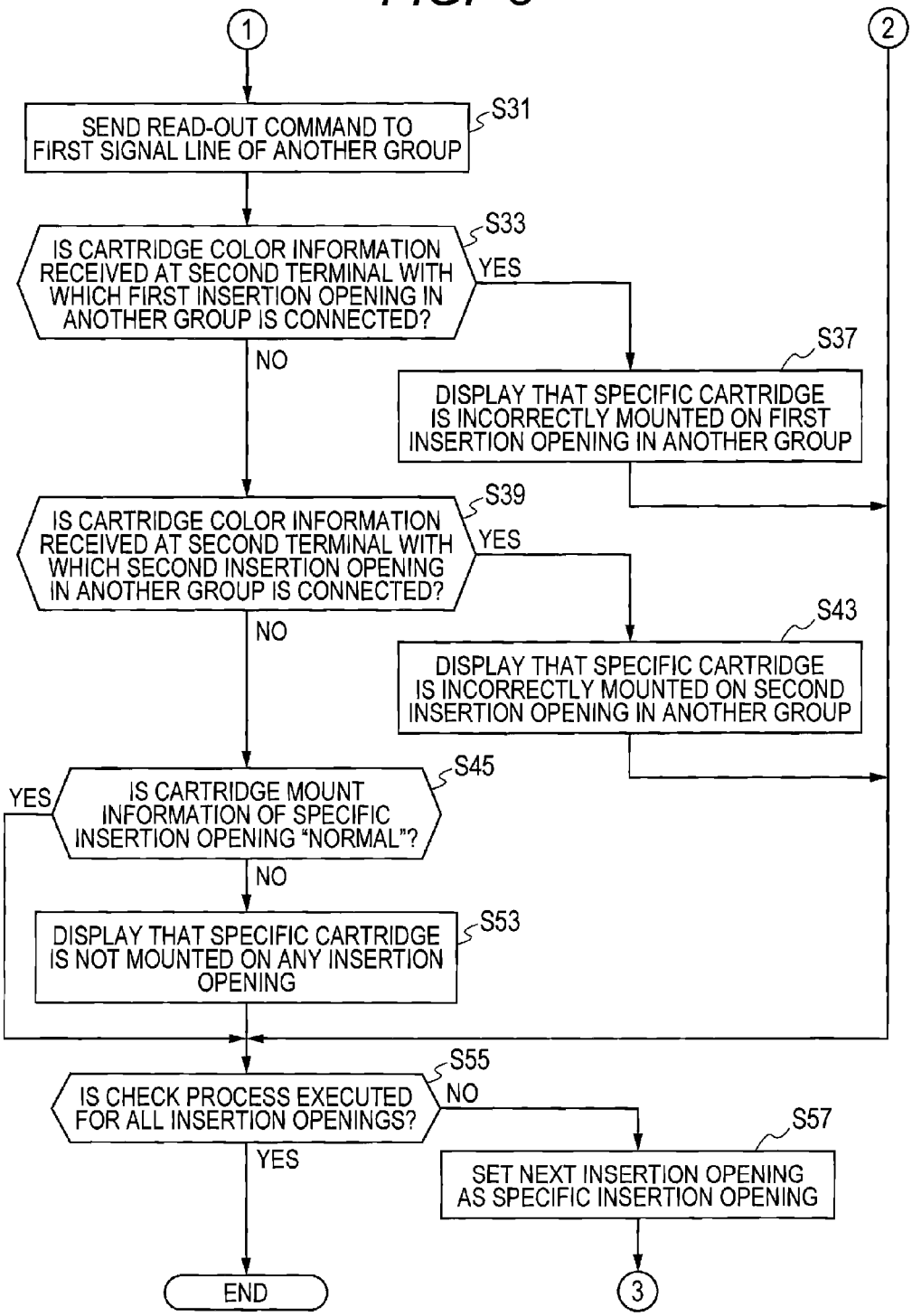
FIG. 3 is a flowchart showing a remaining part of the processes executed by the MFP.

Processes executed by the MFP 51 will be described with reference to the flowchart shown in FIGS. 2 and 3. The flowchart shown in FIGS. 2 and 3 is executed when the power of the MFP 51 is turned on, when a cover (not shown) of the MFP 51 is closed, and the like.

In S9, the ASIC 32 sets, as a specific insertion opening, an insertion opening corresponding to the first sequence of the insertion opening number 120 in the table TB1 (FIG. 4). Further, the ASIC 32 identifies a specific cartridge corresponding to the specific insertion opening. Here, the specific cartridge is a cartridge in color matching the color of the specific insertion opening. Further, the specific insertion opening is an insertion opening for which it is checked whether the specific cartridge is mounted.

In S11, the ASIC 32 transmits a read-out command of the specific cartridge to the first signal line that is connected with a specific group to which the specific insertion opening belongs. The read-out command is a command for causing the specific cartridge (the cartridge in the same color as the color of the specific insertion opening) to output cartridge color information as a response.

In S13, the ASIC 32 determines whether cartridge color information is received at the second terminal with which the second signal line of the specific insertion opening is connected. The ASIC 32 proceeds to S19 if the cartridge color information is not received (S13: No), and proceeds to S15 if the cartridge color information is received (S13: Yes). In S15, the ASIC 32 controls the display panel 39 to display that a cartridge in the same color as the color of the specific insertion opening is correctly mounted on the specific insertion opening. In S17, the ASIC 32 sets the cartridge mount information 114 of the specific insertion opening in the table TB1 to "Normal". The ASIC 32 then proceeds to S19.

In S19, the ASIC 32 determines whether cartridge color information is received at the second terminal with which the second signal line of another insertion opening in the specific group is connected. If the cartridge color information is received (S19: Yes), the ASIC 32 proceeds to S23 and controls the display panel 39 to display that the specific cartridge is incorrectly mounted on the another insertion opening. The ASIC 32 proceeds to S55 (FIG. 3).

If the cartridge color information is not received in S19 (S19: No), the ASIC 32 proceeds to S31 (FIG. 3). In S31, the ASIC 32 transmits a read-out command of the specific cartridge to the first signal line that is connected in common with another group other than the specific group.

In S33, the ASIC 32 determines whether cartridge color information is received at the second terminal with which the first insertion opening in the another group is connected. If the cartridge color information is received (S33: Yes), the ASIC 32 proceeds to S37 and controls the display panel 39 to display that the specific cartridge is incorrectly mounted on the first insertion opening in the another group. The ASIC 32 then proceeds to S55.

If the cartridge color information is not received in S33 (S33: No), the ASIC 32 proceeds to S39. In S39, the ASIC 32 determines whether cartridge color information is received at the second terminal with which the second insertion opening in the another group is connected. If the cartridge color information is received (S39: Yes), the ASIC 32 proceeds to S43 and controls the display panel 39 to display that the specific cartridge is incorrectly mounted on the second insertion opening in the another group. The ASIC 32 then proceeds to S55.

If the cartridge color information is not received in S39 (S39: No), the ASIC 32 proceeds to S45 and determines whether the cartridge mount information 114 (FIG. 4) of the specific insertion opening is set to "Normal". The ASIC 32 proceeds to S55 if the cartridge mount information 114 of the specific insertion opening is "Normal" (S45: Yes), and proceeds to S53 if the cartridge mount information 114 of the specific insertion opening is not "Normal" (S45: No). In S53, the ASIC 32 controls the display panel 39 to display that the specific cartridge is not mounted on any of the insertion openings 60C, 60M, 60Y, and 60K. The ASIC 32 then proceeds to S55.

In S55, the ASIC 32 determines whether the check process is executed for all of the insertion openings. The ASIC 32 ends the processes in the flowchart if the check process is executed for all of the insertion openings (S55: Yes), and proceeds to S57 if the check process is not executed for all of the insertion openings (S55: No). In S57, the ASIC 32 sets, as the specific insertion opening, an insertion opening corresponding to the next sequence of the insertion opening number 120 in the table TB1 (FIG. 4). Further, the ASIC 32 identifies a specific cartridge corresponding to the specific insertion opening that is set this time. The ASIC 32 then returns to S11.

<Example of Processes>

An example of the processes according to the present embodiment will be described. In this example, a case will be described in which the cartridge 64C for cyan is incorrectly mounted on the insertion opening 60K for black, the cartridge 64K for black is incorrectly mounted on the insertion opening 60C for cyan, and the cartridges 64M and 64Y are correctly mounted on the insertion openings 60M and 60Y, respectively.

The ASIC 32 sets, as the specific insertion opening, the insertion opening 60C for which the insertion opening number 120="1" in the table TB1 (FIG. 4) (S9). In this case, the cartridge 64C having the same color as the specific insertion opening 60C is identified as the specific cartridge, based on the corresponding cartridge information 121 (the table TB1). The ASIC 32 transmits the read-out command of the specific cartridge 64C to the first signal line L11 that is connected in common with the specific group G1 to which the specific insertion opening 60C belongs (S11). The first signal line L11 is not connected with the insertion opening 60K on which the specific cartridge 64C is mounted, and thus the read-out command is not received at the specific cartridge 64C. Accordingly, the cartridge color information is not received at the second terminal T21 with which the second signal line L21 of the specific insertion opening 60C is connected (S13: No). Further, the cartridge color information is not received at the second terminal T22 with which the second signal line L22 of the insertion opening 60M (which is another insertion opening in the specific group G1) is connected (S19: No).

Next, the ASIC 32 transmits the read-out command of the specific cartridge 64C to the first signal line L12 that is connected in common with the another group G2 (S31). The first signal line L12 is connected with the insertion opening 60K on which the specific cartridge 64C is mounted, and thus the read-out command is received at the specific cartridge 64C. Hence, the cartridge color information is outputted from the specific cartridge 64C. In this case, the cartridge color information is not received at the second terminal T21 with which the first insertion opening 60Y in the another group G2 is connected (S33: No). However, the cartridge color information is received at the second terminal T22 with which the second insertion opening 60K in the another group G2 is connected (S39: Yes). Hence, the ASIC 32 controls the display panel 39 to display that the cartridge 64C is incorrectly mounted on the second insertion opening 60K in the another group G2 (S43).

Because the check process is not executed for all of the insertion openings (S55: No), the insertion opening 60M in the next sequence (the insertion opening number 120="2") is set as the specific insertion opening (S57). In this case, the cartridge 64M having the same color as the specific insertion opening 60M is identified as the specific cartridge, based on the corresponding cartridge information 121 (the table TB1). The ASIC 32 transmits the read-out command of the specific cartridge 64M to the first signal line L11 that is connected in common with the specific group G1 to which the specific insertion opening 60M belongs (S11). The first signal line L11 is connected with the insertion opening 60M on which the specific cartridge 64M is mounted, and thus the read-out command is received at the specific cartridge 64M. Hence, the specific cartridge 64M outputs cartridge color information. Accordingly, the cartridge color information is received at the second terminal T22 with which the second signal line L22 of the specific insertion opening 60M is connected (S13: Yes). The ASIC 32 controls the display panel 39 to display that the cartridge 64M having the same color as the insertion opening 60M is correctly mounted on the insertion opening 60M (S15). Further, the ASIC 32 sets the cartridge mount information 114 of the specific insertion opening 60M to "Normal" in the table TB1 (S17).

Thereafter, because the cartridge color information is not received at any second terminal (S19: No, S33: No, and S39: No) and because the cartridge mount information 114 (FIG. 4) of the specific insertion opening 60M is set to "Normal" (S45: Yes), the insertion opening 60Y in the next sequence (the insertion opening number 120="3") is set as the specific insertion opening (S57). Note that the processes for the specific insertion opening 60Y is the same as the processes for the above-described specific insertion opening 60M, and hence detailed descriptions are omitted.

Then, the insertion opening 60K in the last sequence (the insertion opening number 120="4") is set as the specific insertion opening (S57). In this case, the cartridge 64K having the same color as the specific insertion opening 60K is identified as the specific cartridge, based on the corresponding cartridge information 121 (the table TB1). The ASIC 32 transmits the read-out command of the specific cartridge 64K to the first signal line L12 that is connected in common with the specific group G2 to which the specific insertion opening 60K belongs (S11). The first signal line L12 is not connected with the insertion opening 60C on which the specific cartridge 64K is mounted, and thus the read-out command is not received at the specific cartridge 64K. Accordingly, the cartridge color information is not received at the second terminal T22 with which the second signal line L22 of the specific insertion opening 60K is connected (S13: No). Further, the cartridge color information is not received at the second terminal T21 with which the second signal line L21 of the insertion opening 60Y (which is the another insertion opening in the specific group G2) is connected (S19: No).

Next, the ASIC 32 transmits the read-out command of the specific cartridge 64K to the first signal line L11 that is connected in common with the another group G1 (S31). Because the first signal line L11 is connected with the insertion opening 60C on which the specific cartridge 64K is mounted, the cartridge color information is outputted from the specific cartridge 64K. Then, the cartridge color information is received at the second terminal T21 with which the first insertion opening 60C in the another group G1 is connected (S33: Yes). Hence, the ASIC 32 controls the display panel 39 to display that the cartridge 64K is incorrectly mounted on the first insertion opening 60C in the another group G1 (S37). Then, because the check process is executed for all of the insertion openings (S55: Yes), the processes in the flowchart end.

<Advantageous Effects>

Figure 5:
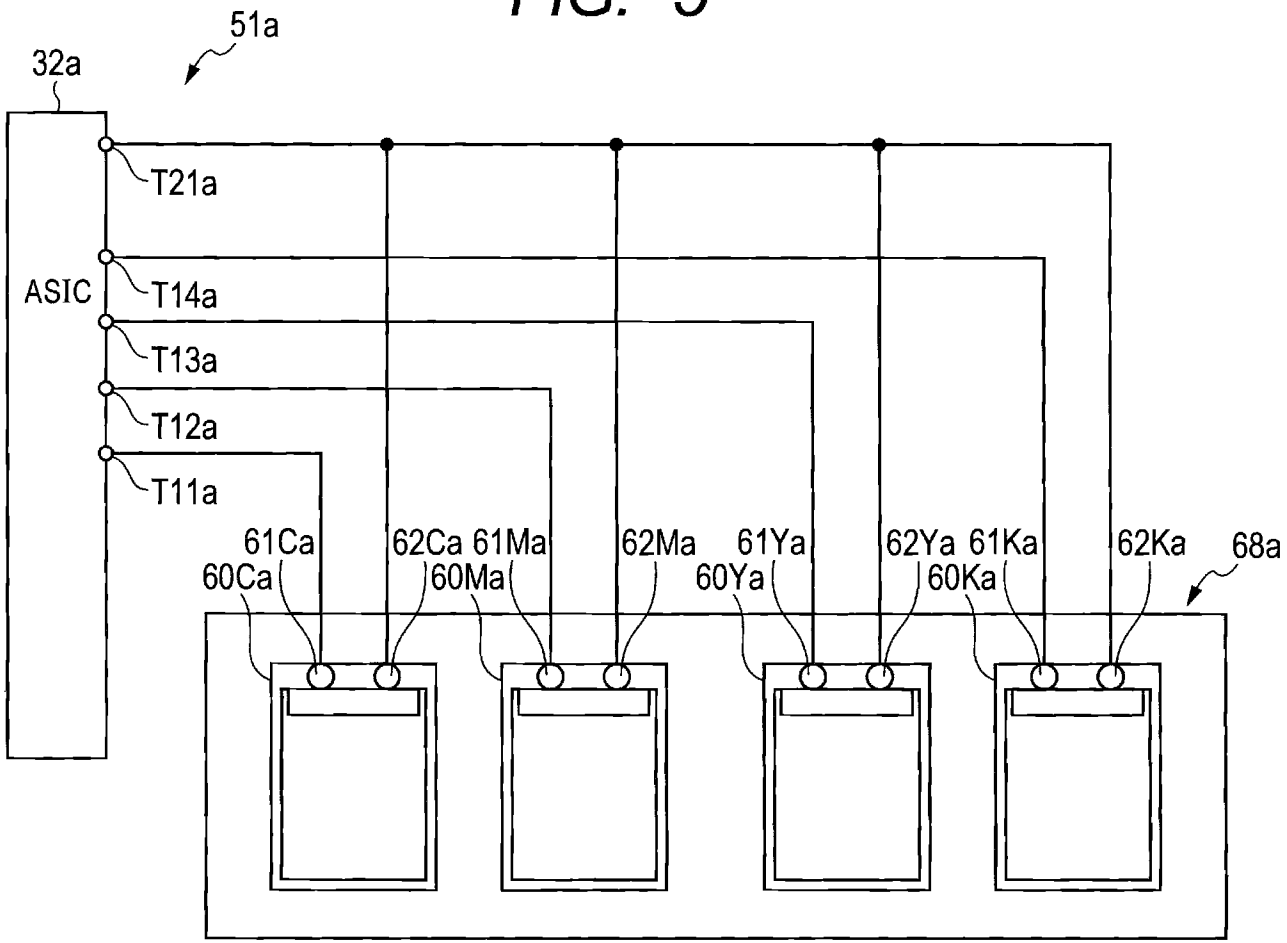
FIG. 5 is a block diagram of an MFP according to a comparative example.

The advantageous effects of the MFP 51 according to the above-described embodiment will be described. As a comparative example, an MFP 51*a* shown in FIG. 5 will be described. The number of insertion openings (60Ca, 60Ma, 60Ya, and 60Ka) provided at a carriage 68*a* of the MFP 51*a* is four (4), which is the same as the MFP 51 shown in FIG. 1. Further, an ASIC 32*a* of the MFP 51*a* includes four (4) first terminals T11*a*, T12*a*, T13*a*, and T14*a* provided for respective ones of the insertion openings. The ASIC 32*a* also includes one (1) second terminal T21*a*. The first terminals T11*a*, T12*a*, T13*a*, and T14*a* are connected with first electrodes 61Ca, 61Ma, 61Ya, and 61Ka of the insertion openings 60Ca, 60Ma, 60Ya, and 60Ka, respectively. The second terminal T21*a* is connected in common with second electrodes 62Ca, 62Ma, 62Ya, and 62Ka of the insertion openings 60Ca, 60Ma, 60Ya, and 60Ka, respectively. That is, the MFP 51*a* has a wiring configuration where the first terminal is separated to correspond to the respective insertion openings, and the second terminal is shared by these insertion openings.

The operations of the MFP 51*a* will be described. The ASIC 32*a* executes, for each of the first terminals T11*a*, T12*a*, T13*a*, and T14*a*, a process of transmitting a read-out command of a specific cartridge from any one of the first terminals and of determining whether cartridge color information is returned to the second terminal. With this process, the cartridge color information is returned to the second terminal only if the read-out command is transmitted to the first terminal that is connected with the insertion opening on which the specific cartridge is mounted. Thus, the insertion opening on which the specific cartridge is mounted can be identified. In the wiring configuration of the MFP 51*a* in FIG. 5, however, five (5) terminals (T11*a*, T12*a*, T13*a*, T14*a*, and T21*a*) are necessary for four (4) insertion openings (60Ca, 60Ma, 60Ya, and 60Ka).

In contrast, in the MFP 51 (FIG. 1) according to the above-described embodiment, the insertion openings 60C and 60M in the group G1 are connected in common with the first terminal T11, and the insertion openings 60Y and 60K in the group G2 are connected in common with the first terminal T12. Further, the insertion openings 60C and 60M in the group G1 are connected with the second terminals T21 and T22, respectively, and the insertion openings 60Y and 60K in the group G2 are connected with the second terminals T21 and T22, respectively. That is, the MFP 51 has a wiring configuration where each of the first terminals and the second terminals provided at the ASIC 32 is always shared by a plurality of insertion openings. In other words, each of the first terminals is connected with two or more insertion openings via the first signal lines, and each of the second terminals is connected with two or more insertion openings via the second signal lines.

With such wiring configuration, the first signal line L11 can be used to check whether the specific cartridge is mounted on an insertion opening in the group G1, and the first signal line L12 can be used to check whether the specific cartridge is mounted on an insertion opening in the group G2. Further, the second signal lines L21 and L22 can be used to determine from which insertion opening in the group G1 the cartridge color information is received, and to determine from which insertion opening in the group G2 the cartridge color information is received. That is, the insertion opening on which the specific cartridge is mounted can be determined unambiguously with a combination of the first signal lines and the second signal lines.

As mentioned above, in the wiring configuration of the MFP 51, each of the first terminals and the second terminals is always shared by a plurality of insertion openings. Thus, four (4) terminals (T11, T12, T21, and T22) are sufficient for four (4) insertion opening (60C, 60M, 60Y, and 60K). Accordingly, in the wiring configuration of the MFP 51 according to the embodiment, the number of necessary terminals in the ASIC can be reduced, compared with the wiring configuration of the MFP 51*a* shown in FIG. 5. This can prevent a problem that the size of the ASIC increases and a situation in which manufacturing costs of the MFP increase.

Figure 6:
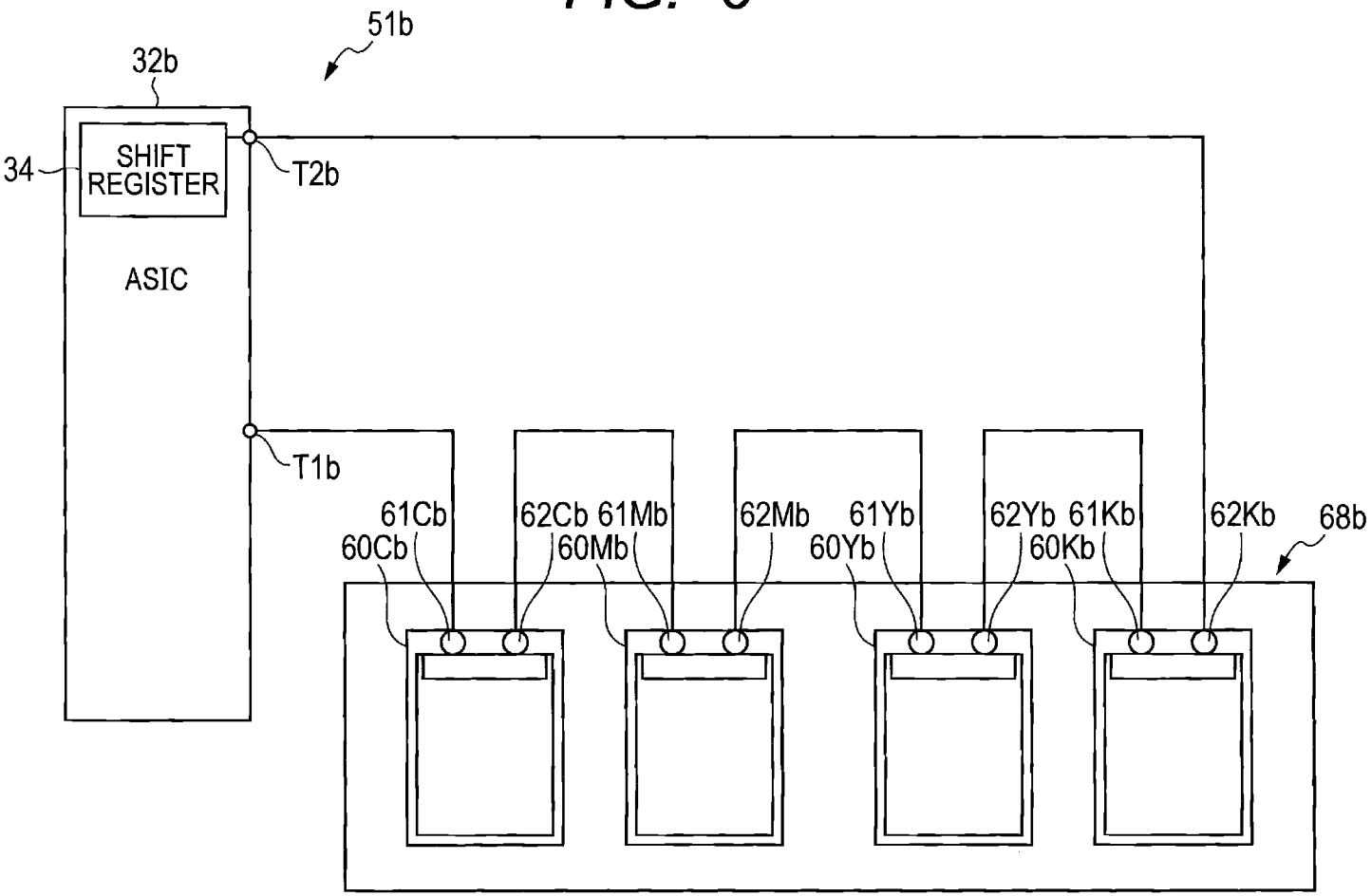
FIG. 6 is a block diagram of an MFP according to another comparative example.

As another comparative example, an MFP 51*b* shown in FIG. 6 will be described. The number of insertion openings (60Cb, 60Mb, 60Yb, and 60Kb) provided at a carriage 68*b* of the MFP 51*b* is four (4), which is the same as the MFP 51 shown in FIG. 1. Further, an ASIC 32*b* of the MFP 51*b* includes a first terminal T1*b* and a second terminal T2*b*. The ASIC 32*b* also includes a shift register 34 therein. The first terminal T1*b* is connected with a first electrode 61Cb of the insertion opening 60Cb. A second electrode 62Kb of the insertion opening 60Kb is connected with the second terminal T2*b*. Further, each of second electrodes 62Cb, 62Mb, and 62Yb is connected with first electrodes 61Mb, 61Yb, and 61Kb of the adjacent insertion opening. That is, the MFP 51*b* has a wiring configuration where the insertion openings 60Cb, 60Mb, 60Yb, and 60Kb are sequentially connected in series.

The operations of the MFP 51*b* will be described. When a read-out command is transmitted from the first terminal T1*b*, individual information is outputted from each of the insertion openings 60Cb, 60Mb, 60Yb, and 60Kb as a serial signal, and is inputted into the second terminal T2*b*. The shift register 34 retains the serial signal and analyzes the serial signal. Accordingly, in the wiring configuration of the MFP 51*b* shown in FIG. 6, two (2) terminals (T1*b* and T2*b*) are provided for four (4) insertion openings (60Cb, 60Mb, 60Yb, and 60Kb). However, a circuit for handling a serial signal (the shift register 34 or the like) is required.

In contrast, the MFP 51 (FIG. 1) according to the above-described embodiment has a wiring configuration where each of the first terminals and the second terminals provided at the ASIC 32 is always shared by a plurality of insertion openings. Thus, parallel communication can be performed with insertion openings in each group while minimizing the number of terminals of the ASIC 32. With such a configuration, a circuit such as the shift register 34 required for serial communication is unnecessary. This can prevent a situation in which a circuit for communicating with insertion openings (insertion sections) is complicated, thereby preventing a problem that the size of the ASIC increases and a situation in which manufacturing costs of the MFP increase.

Further, with the MFP 51 according to the above-described embodiment, a notification is provided to a user or the like that a cartridge having the same color as the specific insertion opening is mounted on another insertion opening (S23, S37, and S43). This enables the user to readily find the insertion opening on which a cartridge of an incorrect color is mounted.

Further, with the MFP 51 according to the above-described embodiment, a notification is provided to a user or the like that a cartridge having the same color as the specific insertion opening is not mounted on any insertion opening (S53), which improves convenience of the user.

Further, with the MFP 51 according to the above-described embodiment, if a cartridge in the same color as the specific insertion opening is correctly mounted on the specific insertion opening (S13: Yes), the cartridge mount information 114 is set to "Normal" (S17) and a check process is continued for other insertion openings (S19, S33, and S39). Hence, detection can be performed even if cartridges in the same color are mounted on two insertion openings or more.

<Modifications>

While the invention has been described in detail with reference to the above aspects thereof, it would be apparent to those skilled in the art that various changes and modifications may be made therein without departing from the scope of the claims. In the following descriptions, like parts and components are designated by the same reference numerals to avoid duplicating description.

Figure 7:
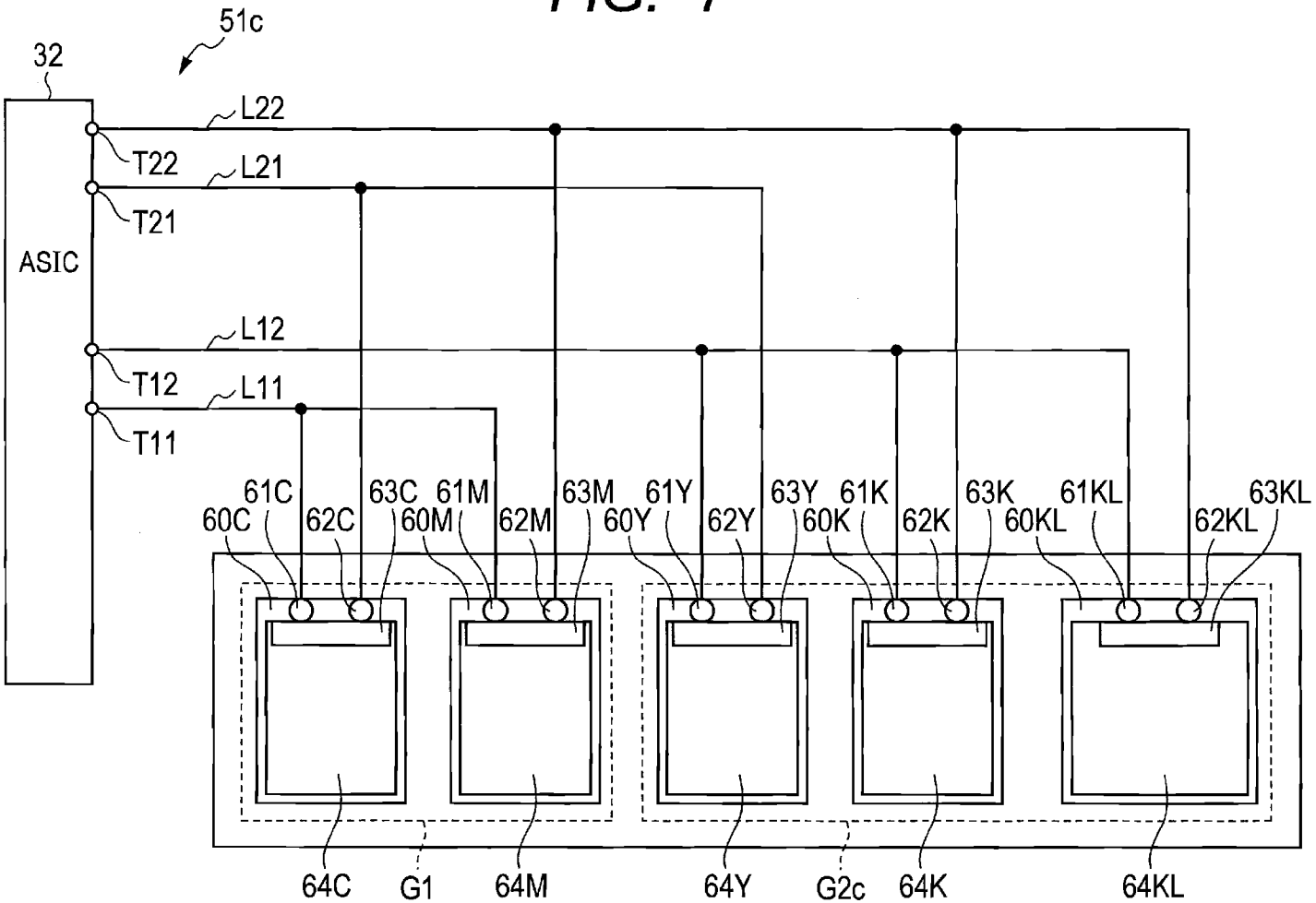
FIG. 7 is a block diagram of an MFP according to a modification.

FIG. 7 shows an MFP 51*c* according to a modification. The MFP 51*c* includes a large insertion opening 60KL, in addition to the insertion openings of the MFP 51 shown in FIG. 1. The large insertion opening 60KL has a shape on which only a large cartridge 64KL can be mounted. On the other hand, the normal insertion opening (60C, 60M, 60Y, 60K) has a shape on which only a normal cartridge (64C, 64M, 64Y, 64K) can be mounted. A group G2*c* is constituted by the insertion openings 60Y, 60K, and 60KL of which the first signal lines L12 are connected with the common first terminal T12. A first electrode 61KL of the large insertion opening 60KL in the group G2*c* is connected with the first terminal T12 with which the first electrodes of the insertion openings 60Y and 60K in the same group are connected. A second electrode 62KL of the large insertion opening 60KL in the group G2*c* is connected with the second terminal T22 with which the second electrode 62K of the insertion opening 60K in the same group is connected. That is, the large insertion opening 60KL is connected with the first terminal T12 that is also connected with the counterpart insertion opening 60K, and the large insertion opening 60KL is connected with the second terminal T22 that is also connected with the counterpart insertion opening 60K. This configuration enables the ASIC 32 to communicate with an IC chip 63KL of the large cartridge 64KL mounted on the large insertion opening 60KL.

In order to check whether the large cartridge 64KL is correctly mounted on the large insertion opening 60KL, the large cartridge 64KL is set as the specific cartridge, and the large insertion opening 60KL is set as the specific insertion opening. The ASIC 32 transmits a read-out command of the large cartridge 64KL (the specific cartridge) to the first signal line L12 that is connected in common with the group G2*c* (the specific group) including the large insertion opening 60KL. If the large cartridge 64KL is correctly mounted on the large insertion opening 60KL, the read-out command is received at the large cartridge 64KL, and cartridge color information is received at the second terminal T22 that is connected with the second signal line L22 of the large insertion opening 60KL.

The advantageous effects of the MFP 51*c* in FIG. 7 will be described. Because the large cartridge 64KL can be mounted only on the large insertion opening 60KL, the kind of a cartridge mounted on the large insertion opening 60KL need not be determined by communication. Hence, the first terminal T12 and second terminals T21 and T22 used for the insertion openings 60Y and 60K can also be used for the large insertion opening 60KL. That is, the large insertion opening 60KL is added to the group G2*c* without increasing the number of terminals of the ASIC 32. This prevents an increase in the number of terminals of the ASIC 32.

In the above-described embodiment, the read-out command of the specific cartridge is transmitted from the first terminal, and the cartridge color information is received at the second terminal Alternatively, for example, an active signal for putting the IC chip of the specific cartridge in an active state may be transmitted from the first terminal, and an actuating signal for actuating the IC chip of the specific cartridge may be transmitted from the second terminal. Then, the IC chip of the specific cartridge may output a return signal to the ASIC if both of the active signal and the actuating signal are received. In this modification, an insertion opening on which the specific cartridge is mounted can be unambiguously determined. In this modification, if both of the active signal and the actuating signal are received, the IC chip of the specific cartridge performs an operation of writing the actuating signal in the IC chip and an operation of outputting a return signal. An example of the active signal includes a clock signal, and an example of the actuating signal includes a data signal. An example will be described in which communication with the cartridge 64C is required in the embodiment of FIG. 1. Assume that the cartridge 64C is correctly mounted on the insertion opening 60C. If a clock signal is transmitted from the first terminal T11, the cartridges 64C and 64M become active. Then, if a data signal is transmitted from the second terminal T21, the cartridge 64C returns a return signal through the second signal line L21. Although the cartridge 64Y also receives the data signal, the cartridge 64Y does not respond because it is not active. In this way, the ASIC 32 can determine that the cartridge 64C is correctly mounted on the insertion opening 60C.

Figure 8:
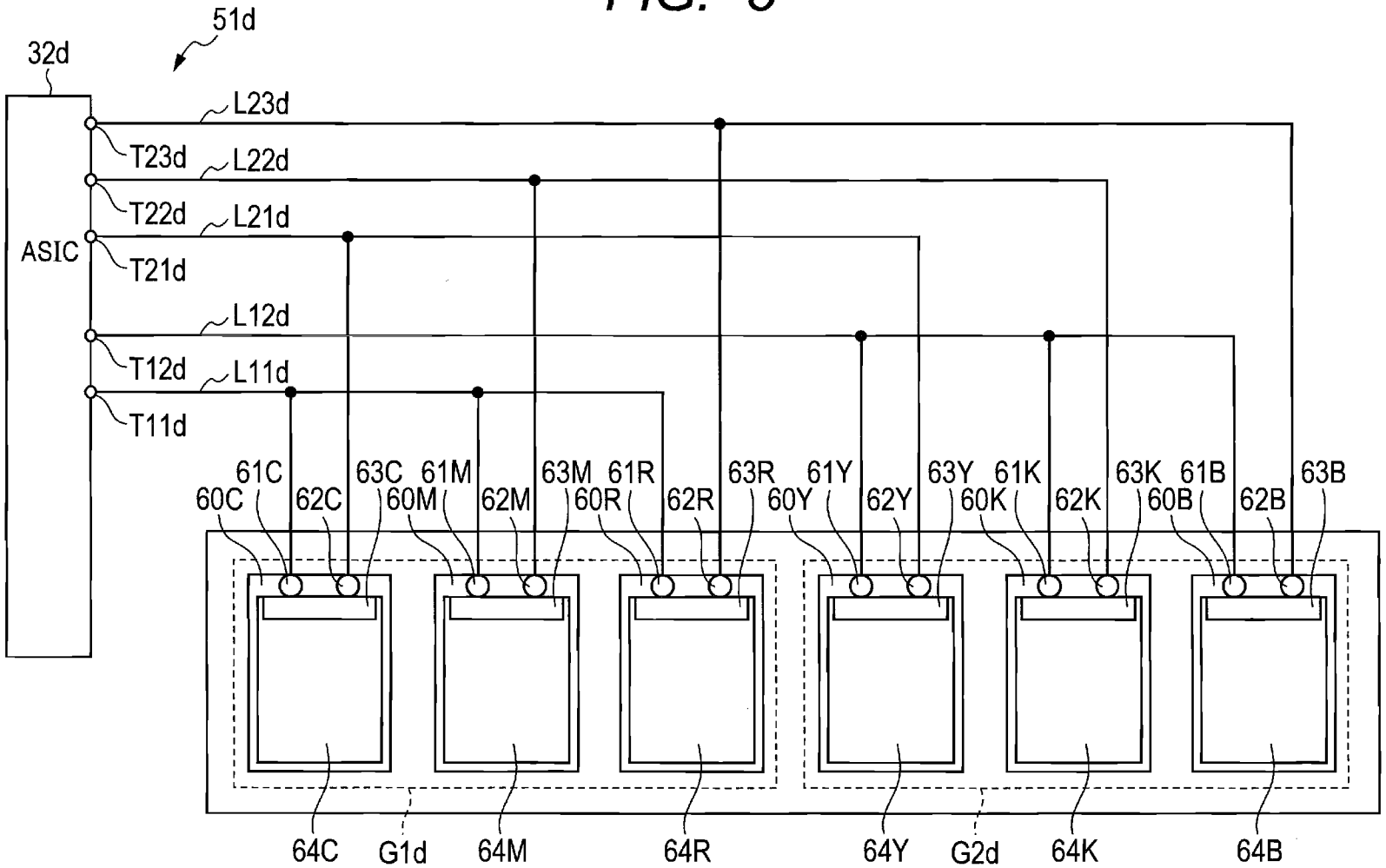
FIG. 8 is a block diagram of an MFP according to another modification.

Further, the number of the insertion openings is not limited to four (4). The number of the insertion openings may be five (5) or more, as long as a printing device has a wiring configuration where each of the first terminals and the second terminals provided at the ASIC is always shared by a plurality of insertion openings. FIG. 8 shows an MFP 51*d* including six (6) insertion openings (60C, 60M, 60R, 60Y, 60K, and 60B). The insertion openings 60R and 60B correspond to colors of red and blue, respectively. A first terminal T11*d* is connected with first electrodes 61C, 61M, and 61R. A first terminal T12*d* is connected with first electrodes 61Y, 61K, and 61B. A second terminal T21*d* is connected with second electrodes 62C and 62Y. A second terminal T22*d* is connected with second electrodes 62M and 62K. A second terminal T23*d* is connected with second electrodes 62R and 62B. A group G2*d* is constituted by the insertion openings 60C, 60M, and 60R of which a first signal line L11*d* is connected with the common first terminal T11*d*. Further, a group G2*d* is constituted by the insertion openings 60Y, 60K, and 60B of which a first signal line L12*d* is connected with the common first terminal T12*d*. With such a wiring configuration, the first signal line L11*d* can be used to check whether the specific cartridge is mounted on an insertion opening in the group G1*d*, and the first signal line L12*d* can be used to check whether the specific cartridge is mounted on an insertion opening in the group G2*d*. Further, the second signal lines L21*d*, L22*d*, and L23*d* can be used to determine from which insertion opening in the group G1*d* the cartridge color information is received, and to determine from which insertion opening in the group G2*d* the cartridge color information is received.

Further, in the MFP 51*c* shown in FIG. 7, the number of the large insertion opening is not limited to one (1). The large insertion opening can be connected in parallel with each of the normal insertion opening (60C, 60M, 60Y, and 60K). Hence, in the MFP 51*c* shown in FIG. 7, a maximum of four (4) large insertion openings can be provided. Here, the normal cartridge has such a shape that can be mounted only on the normal insertion opening, and the large cartridge has such a shape that can be mounted only on the large insertion opening. Hence, the first and second signal lines can be shared by a normal insertion opening and its counterpart large insertion opening.

In the above-described embodiment, the read-out command of the specific cartridge is transmitted from the first terminal, and the cartridge color information is received at the second terminal. Alternatively, the read-out command of the specific cartridge may be transmitted from the second terminal, and the cartridge color information may be received at the first terminal.

In the above-described embodiment, the number of kinds of used ink is four (4), which is cyan, magenta, yellow, and black. However, the number of kinds of used ink may be less than or equal to three (3) or be larger than or equal to five (5). Further, developer accommodated in a cartridge is not limited to ink, but may be another developer such as toner.

In the above-described embodiment, the IC chips 63C, 63M, 63Y, and 63K are contact-type ICs. However, noncontact-type ICs may be used.

What is claimed is:

1. A printing device comprising:

a printer section configured to perform printing on a recording medium with developer;

a plurality of first mount sections on which a plurality of kinds of first cartridges is configured to be mounted respectively, each of the plurality of kinds of first cartridges having a memory element for storing cartridge information;

a communicating section configured to communicate with the memory element for each of the plurality of kinds of first cartridges via the plurality of first mount sections, the communicating section having a plurality of first terminals and a plurality of second terminals;

a plurality of first signal lines connecting the plurality of first terminals with the plurality of first mount sections; and a plurality of second signal lines connecting the plurality of second terminals with the plurality of first mount sections, wherein the plurality of first mount sections forms a plurality of groups, each of the plurality of groups having two or more first mount sections, the two or more first mount sections in each group being connected in common with one of the first terminals via a corresponding first signal line;

wherein the two or more first mount sections in one group are connected with respective ones of the plurality of second terminals via respective second signal lines, and each of the second terminals is connected with one of the two or more first mount sections in one group and with one of the two or more first mount sections in another group via a corresponding second signal line; and wherein each of the first terminals is connected with the two or more first mount sections in a specific group, but is not connected with the two or more first mount sections in a group other than the specific group.

2. The printing device according to claim 1, wherein the communicating section is configured to transmit a first signal to the first signal line that is connected in common with the two or more first mount sections in a specific group including a specific first mount section, the first signal being a signal for receiving a second signal as a response via the second signal line from a first cartridge corresponding to a kind of the specific first mount section; and wherein, if the communicating section transmits the first signal to the first signal line that is connected in common with the two or more first mount sections in the specific group and fails to receive the second signal at the second terminal that is connected with the second signal line of the specific first mount section, the communicating section executes a check process for the plurality of first mount sections other than the specific first mount section.

3. The printing device according to claim 2, wherein the second signal is the cartridge information stored in the memory element; and wherein the first signal is a command signal for reading out the cartridge information, via the second signal line, from the first cartridge corresponding to the kind of the specific first mount section.

4. The printing device according to claim 2, wherein the first signal is an active signal for putting the memory element of the specific first cartridge in an active state;

wherein the second signal is an actuating signal for actuating the memory element of the specific first cartridge; and wherein the memory element of the specific first cartridge is put in a state where communication can be performed if both the active signal and the actuating signal are received.

5. The printing device according to claim 1, wherein the communicating section is configured to transmit a first signal to the first signal line that is connected in common with the two or more first mount sections in a specific group including a specific first mount section, the first signal being a signal for receiving a second signal as a response via the second signal line from a first cartridge corresponding to a kind of the specific first mount section; and wherein, if the communicating section transmits the first signal to the first signal line that is connected in common with the two or more first mount sections in the specific group and receives the second signal at the second terminal that is connected with the second signal line of another first mount section in the specific group, the communicating section provides a notification that a specific first cartridge corresponding to the kind of the specific first mount section is mounted on the another first mount section.

6. The printing device according to claim 1, wherein the communicating section is configured to transmit a first signal to the first signal line that is connected in common with the two or more first mount sections in a specific group including a specific first mount section, the first signal being a signal for receiving a second signal as a response via the second signal line from a first cartridge corresponding to a kind of the specific first mount section;

wherein, if the communicating section transmits the first signal to the first signal line that is connected in common with the two or more first mount sections in the specific group and fails to receive the second signal at all of the second terminals that are connected with the two or more first mount sections in the specific group, the communicating section transmits the first signal to another first signal line that is connected in common with the two or more first mount sections in another group other than the specific group; and wherein, if the communicating section receives the second signal at any one of the second terminals that are connected with the two or more first mount sections in the another group, the communicating section provides a notification that a specific first cartridge corresponding to the kind of the specific first mount section is mounted on the first mount section corresponding to the second terminal at which the second signal is received.

7. The printing device according to claim 6, wherein, if the communicating section transmits the first signal to the another first signal line and fails to receive the second signal at all of the second terminals that are connected with the two or more first mount sections in the another group, the communicating section provides a notification that the first cartridge corresponding to the kind of the specific first mount section is mounted on none of the plurality of first mount sections.

8. The printing device according to claim 1, wherein the communicating section is configured to transmit a first signal to the first signal line that is connected in common with the two or more first mount sections in a specific group including a specific first mount section, the first signal being a signal for receiving a second signal as a response via the second signal line from a first cartridge corresponding to a kind of the specific first mount section; and wherein, if the communicating section transmits the first signal to the first signal line that is connected in common with the two or more first mount sections in the specific group and receives the second signal at the second terminal that is connected with the second signal line of the specific first mount section, the communicating section provides a notification that a specific first cartridge corresponding to the kind of the specific first mount section is correctly mounted on the specific first mount section.

9. The printing device according to claim 8, further comprising a storage section configured to store cartridge mount information for indicating whether a cartridge in color matching color of each first mount section is mounted, wherein, if the communicating section transmits the first signal to the first signal line that is connected in common with the two or more first mount sections in the specific group and receives the second signal at the second terminal that is connected with the second signal line of the specific first mount section, the communicating section sets the cartridge mount information to "Normal" and continues a check process for the other first mount sections.

10. The printing device according to claim 1, further comprising at least one second mount section on which at least one kind of second cartridge each having the memory element can be mounted, wherein each first cartridge has such a shape that can be mounted only on the first mount section;

wherein each second cartridge has such a shape that can be mounted only on the second mount section;

wherein the communicating section is configured to communicate with the memory element of the second cartridge mounted on each second mount section;

wherein the first signal line further connects the first terminal with the at least one second mount section;

wherein the second signal line further connects the second terminal with the at least one second mount section; and wherein the at least one second mount section is connected with the first and second terminals in parallel with a counterpart first mount section.

11. The printing device according to claim 10, wherein each second mount section is connected with the first terminal that is connected with the counterpart first mount section; and wherein each second mount section is connected with the second terminal that is connected with the counterpart first mount section.

12. A printing device comprising:

a printer section configured to perform printing on a recording medium with developer;

a plurality of first mount sections on which a plurality of kinds of first cartridges is configured to be mounted respectively, each of the plurality of kinds of first cartridges having a memory element for storing cartridge information;

a communicating section configured to communicate with the memory element for each of the plurality of kinds of first cartridges via the plurality of first mount sections, the communicating section having a plurality of first terminals and a plurality of second terminals;

a plurality of first signal lines connecting the plurality of first terminals with the plurality of first mount sections; and a plurality of second signal lines connecting the plurality of second terminals with the plurality of first mount sections, wherein the plurality of first mount sections forms a plurality of groups, each of the plurality of groups having two or more first mount sections, the two or more first mount sections in each group being connected in common with one of the first terminals via a corresponding first signal line;

wherein the two or more first mount sections in one group are connected with respective ones of the plurality of second terminals via respective second signal lines, and each of the second terminals is connected with one of the two or more first mount sections in one group and with the one of the two or more first mount sections in another group via a corresponding second signal line wherein the communicating section is configured to transmit a first signal to the first signal line that is connected in common with the two or more first mount sections in a specific group including a specific first mount section, the first signal being a signal for receiving a second signal as a response via the second signal line from a first cartridge corresponding to a kind of the specific first mount section; and wherein, if the communicating section transmits the first signal to the first signal line that is connected in common with the two or more first mount sections in the specific group and fails to receive the second signal at the second terminal that is connected with the second signal line of the specific first mount section, the communicating section executes a check process for the plurality of first mount sections other than the specific first mount section.

13. The printing device according to claim 12, wherein, if the communicating section receives the second signal at the second terminal that is connected with the second signal line of another first mount section in the specific group, the communicating section provides a notification that a specific first cartridge corresponding to the kind of the specific first mount section is mounted on the another first mount section.

14. The printing device according to claim 12, wherein, if the communicating section fails to receive the second signal at all of the second terminals that are connected with the two or more first mount sections in the specific group, the communicating section transmits the first signal to another first signal line that is connected in common with the two or more first mount sections in another group other than the specific group; and wherein, if the communicating section receives the second signal at any one of the second terminals that are connected with the two or more first mount sections in the another group, the communicating section provides a notification that a specific first cartridge corresponding to the kind of the specific first mount section is mounted on the first mount section corresponding to the second terminal at which the second signal is received.

15. The printing device according to claim 14, wherein, if the communicating section transmits the first signal to the another first signal line and fails to receive the second signal at all of the second terminals that are connected with the two or more first mount sections in the another group, the communicating section provides a notification that the first cartridge corresponding to the kind of the specific first mount section is mounted on none of the plurality of first mount sections.

16. The printing device according to claim 12, wherein the second signal is the cartridge information stored in the memory element; and wherein the first signal is a command signal for reading out the cartridge information, via the second signal line, from the first cartridge corresponding to the kind of the specific first mount section.

17. The printing device according to claim 12, wherein the first signal is an active signal for putting the memory element of the specific first cartridge in an active state;

wherein the second signal is an actuating signal for actuating the memory element of the specific first cartridge; and wherein the memory element of the specific first cartridge is put in a state where communication can be performed if both the active signal and the actuating signal are received.

18. A printing device comprising:

a printer section configured to perform printing on a recording medium with developer, a plurality of first mount sections on which a plurality of kinds of first cartridges is configured to be mounted respectively, each of the plurality of kinds of first cartridges having a memory element for storing cartridge information;

a communicating section configured to communicate with the memory element for each of the plurality of kinds of first cartridges via the plurality of first mount sections, the communicating section having a plurality of first terminals and a plurality of second terminals;

a plurality of first signal lines connecting the plurality of first terminals with the plurality of first mount sections; and a plurality of second signal lines connecting the plurality of second terminals with the plurality of first mount sections, wherein the plurality of first mount sections forms a plurality of groups, each of the plurality of groups having two or more first mount sections, the two or more first mount sections in each group being connected in common with one of the first terminals via a corresponding first signal line;

wherein the two or more first mount sections in one group are connected with respective ones of the plurality of second terminals via respective second signal lines, and each of the second terminals is connected with one of the two or more first mount sections in one group and with one of the two or more first mount sections in another group via a corresponding second signal line wherein the communicating section is configured to transmit a first signal to the first signal line that is connected in common with the two or more first mount sections in a specific group including a specific first mount section, the first signal being a signal for receiving a second signal as a response via the second signal line from a first cartridge corresponding to a kind of the specific first mount section;

wherein, if the communicating section transmits the first signal to the first signal line that is connected in common with the two or more first mount sections in the specific group and fails to receive the second signal at all of the second terminals that are connected with the two or more first mount sections in the specific group and fails to receive the second signal at all of the second terminals that are connected with the two or more first mount sections in the specific group, the communicating section transmits the first signal to another first signal line that is connected in common with the two or more first mount sections in another group other than the specific group; and wherein, if the communicating section receives the second signal at any one of the second terminals that are connected with the two or more first mount sections in the another group, the communicating section provides a notification that a specific first cartridge corresponding to the kind of the specific first mount section is mounted on the first mount section corresponding to the second terminal at which the second signal is received.

19. The printing device according to claim 18, wherein, if the communicating section transmits the first signal to another first signal line and fails to receive the second signal at all of the second terminals that are connected with the two or more first mount sections in another group, the communicating section provides a notification that the first cartridge corresponding to the kind of the specific first mount section is mounted on none of the plurality of first mount sections.

20. The printing device according to claim 19, wherein first signal is an active signal for putting the memory element of the specific first cartridge in an active state;

wherein the second signal is an actuating signal for actuating the memory element of the specific first cartridge; and wherein the memory element of the specific first cartridge is put in a state where communication can be performed if both the active signal and the actuating signal are received.

* * * * *